US010344409B2

(12) United States Patent
Sezer

(10) Patent No.: US 10,344,409 B2
(45) Date of Patent: Jul. 9, 2019

(54) METHOD OF INCREASING ABRASION RESISTANCE IN NONWOVEN AUTOMOTIVE TEXTILES

(71) Applicant: PIMSA OTOMOTIV TEKSTILLERI SANAYI VE TICARET ANONIM SIRKETI, Çayirova, Kocaeli (TR)

(72) Inventor: Serdar Sezer, Kocaeli (TR)

(73) Assignee: PIMSA OTOMOTIV TEKSTIKKERI SANAYI VE TICARET ANONI, Kocaeli (TR)

( * ) Notice: Subject to any disclaimer, the term of this patent is extended or adjusted under 35 U.S.C. 154(b) by 0 days.

(21) Appl. No.: 15/542,299

(22) PCT Filed: Oct. 4, 2016

(86) PCT No.: PCT/TR2016/050366
§ 371 (c)(1),
(2) Date: Jul. 7, 2017

(87) PCT Pub. No.: WO2017/061970
PCT Pub. Date: Apr. 13, 2017

(65) Prior Publication Data

US 2018/0266026 A1 Sep. 20, 2018

(30) Foreign Application Priority Data

Oct. 6, 2015 (TR) ..... a 2015 12359

(51) Int. Cl.
*D04H 1/485* (2012.01)
*D04H 1/541* (2012.01)
*D04H 1/55* (2012.01)

(52) U.S. Cl.
CPC ..... *D04H 1/485* (2013.01); *D04H 1/541* (2013.01); *D04H 1/55* (2013.01)

(58) Field of Classification Search
CPC ..... D04H 1/485; D04H 1/541
See application file for complete search history.

(56) References Cited

U.S. PATENT DOCUMENTS 4,568,581 A * 2/1986 Peoples, Jr. ..... D04H 1/558 19/302
4,582,750 A * 4/1986 Lou ..... D04H 1/48 156/148
5,958,322 A * 9/1999 Thompson ..... D04H 1/72 156/161
2002/0019206 A1* 2/2002 Deka ..... A44B 18/0011 451/526

(Continued)

FOREIGN PATENT DOCUMENTS

EP 2484826 A1 * 8/2012
JP 2000-199161 A * 7/2000
WO WO-2009/088381 A1 * 7/2009

*Primary Examiner* — Jeffry H Aftergut
(74) *Attorney, Agent, or Firm* — Egbert Law Offices, PLLC

(57) ABSTRACT

A production method which increases the abrasion resistance of nonwoven textiles used in the automotive sector includes the operation steps of mixing of two or more fibers that have different melting points, application of opening, carding, and needle operations on the fiber on the texture production line, and fiber root binding in a ram drying oven without the need for using any chemical substance.

3 Claims, 1 Drawing Sheet

(56) References Cited

U.S. PATENT DOCUMENTS

| | | | | |
|---|---|---|---|---|
| 2003/0040244 | A1* | 2/2003 | Yamamoto | B32B 5/26<br>442/415 |
| 2003/0045192 | A1* | 3/2003 | Midkiff | B01D 39/163<br>442/103 |
| 2003/0216099 | A1* | 11/2003 | Berrigan | D01D 5/0985<br>442/409 |

* cited by examiner

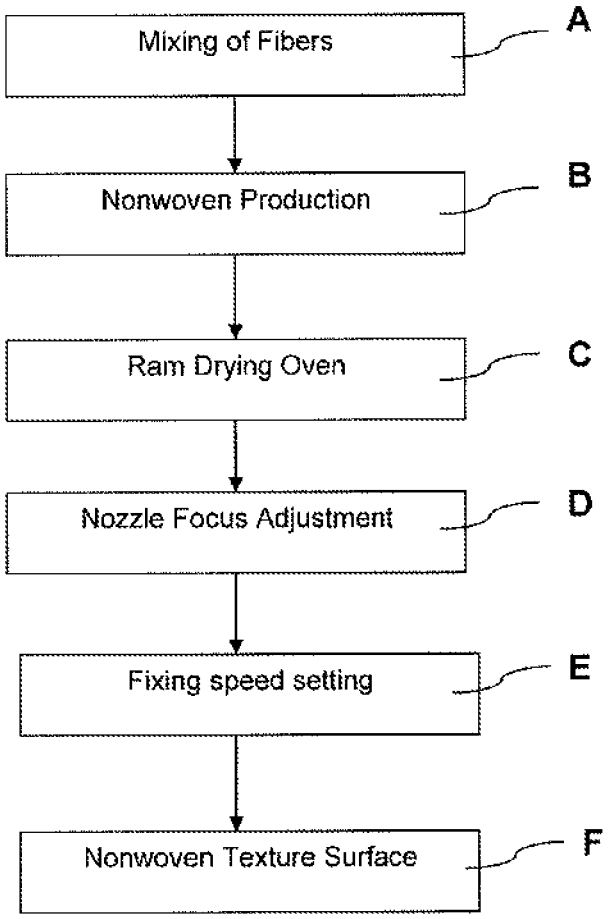
Mixing of Fibers
A
Nonwoven Production
B
Ram Drying Oven
C
Nozzle Focus Adjustment
D
Fixing speed setting
E
Nonwoven Texture Surface
F

METHOD OF INCREASING ABRASION RESISTANCE IN NONWOVEN AUTOMOTIVE TEXTILES

THE RELATED ART

The invention relates to a method, which enables recycling of nonwoven automotive textile products, and increases the abrasion resistance of nonwoven automotive textiles.

THE PRIOR ART

Especially with the recent development of the technology used in automotive sector, it is of great importance to produce lighter, faster, silenter, and cheaper vehicles. At the same time, optional hardware with high technology and diversity has become standard hardware. In all interior trim parts used in vehicle production, recyclable components are preferred. Use of chemicals is strictly avoided.

In the prior art, fibers of Nonwoven Automotive Textiles are bonded by chemical additives. Chemically bonded Nonwoven Automotive Textiles do not meet the minimum abrasion levels demanded by clients. Due to these chemical substances, nonwoven textiles become impossible to recycle. Moreover, odour and other technical problems occur in these textiles due to the use of chemicals.

In the prior art, ram drying ovens are used in nonwoven automotive textile production. Ram drying ovens perform the tasks of drying the natural or synthetic adhesive applied behind the texture and formation of a film layer. The film formed at the rear layer binds the root parts of the fibers and thus gives the final product characteristics such as formability, non-abrasion, and non-pilling. Under normal conditions, the texture is made of 100% PES fiber in accordance with the specifications. The melting point of this fiber is around 220° C. The texture ground is coated using chemical binders such as Latex, PVA etc.

In the patent research made about the prior art, a U.S. Pat. No. 7,846,282 is encountered. In the abstract part of this patent document, it is disclosed that the invention is a textile product used in automobiles, wherein a nonwoven texture is obtained by melting and passing an adhesive film, or in other words, thermoplastic resin having a melt flow rate of 10 to 1,000 g/min through an extruder. The surface coating material obtained following extrusion show exceptionally high sound absorbency and sound insulation characteristics.

In another U.S. Pat. No. 8,091,684, a floor textile product used in vehicles is disclosed, which comprises a surface layer and a fiber material for carpet. In addition, the carpet layer comprises a primary support layer, a rear coating layer, and a perforated film layer between an upper fiber layer and a lower fiber layer. Moreover, it comprises a perforated film layer providing improved sound insulation.

DESCRIPTION OF THE INVENTION

The purpose of the invention is to provide a novel technique that brings an initiative to the related technical field compared to the prior art automotive textiles.

A purpose of the invention is to enable binding of fibers with each other without using the chemicals used in the prior art in order to allow recycling of textiles.

A significant purpose of the invention is to ensure binding of fibers by means of adding low-melt fiber to the textile instead of using chemical compositions and controlling the temperature values and temperature focusing surface during finishing process.

Another purpose of the invention is to eliminate the use of synthetic rubber (Latex) in production of interior trim materials, carpet, and felt used in vehicles.

Another purpose of the invention is to completely abandon the use of adhesive chemicals via the new production technique.

Another purpose of the invention is to provide an eco-friendly product that is alternative to use of chemicals as a binding method of fibers.

REFERENCE NUMBERS

A Mixing of Fibers
B Nonwoven Production
C Ram Drying Oven
D Nozzle Focus Adjustment
E Fixing speed setting
F Nonwoven Texture Surface

BRIEF DESCRIPTION OF THE DRAWINGS

FIG. 1 is a block diagram showing the process of the present invention.

DETAILED DESCRIPTION OF THE INVENTION

Mixing of fibers at certain ratios (A); PES Bico fiber having a low melting point and PES fiber having a high melting point are mixed at certain ratios homogeneously with fiber opening and carding operations as in the normal process.

Nonwoven texture production (B); a new mixed nonwoven is obtained by adding about 20% PES fiber that has a lower melting point (120° C.) into the PES fiber mixture. The subsequent carding and needle processes are the same as before.

Ram drying oven (C); the ram drying oven only performs the task of fixing and melting by heat and binding. No chemical is used.

Nozzle focus adjustment (D); blowing of hot air behind the nonwoven layer is absolutely a must. Optimum focus setting is found so that the nonwoven layer would act as an air curtain and the heat would be collected only on the nonwoven surface, and the warm air coming out of the nozzles would be gathered only on a single point. In this way, a barrier surface is obtained, which is formed at the rear surface via high temperature and melting. Molten fibers also perform the task of root binding. Bico fibers forming a homogeneous root structure also give the nonwoven textile formability.

Nonwoven fabric texture surface (F); no deformation occurs on the carpet surface that is exposed to a low temperature such as 120° C. Temperature distribution within the layer tends to change to 120° C. from 160° C.

A novel type of PES fiber is preferred with a radical change made on fiber mixtures used in nonwoven textile production. This fiber is admixed to standard PES fiber mixture in 20% ratio (A). A novel type of PES fiber is preferred with a radical change made on other fiber mixtures used in bundle dispersion, fiber mixing, and nonwoven textile production. This fiber is admixed to standard PES fiber mixture in 20% ratio (A). The other bundle dispersion, fiber mixing, carding, needle methods are same. The texture obtained in this mixture is rolled to be carried to other processes.

The nonwoven textile (preferably) provided with a pattern via needle method at intermediate processes is then carried to ram drying oven (C) process. The most significant change and invention here is complete elimination of chemical. By means of the nozzle focus adjustment (D) method obtained as a result of extensive studies, warm air is blown behind the texture such that it would form a barrier at a lower temperature and the Bico fibers only at the ground level are molten and bound to other PES fibers. At the same time, the ground root, foundation formation is completed. While these operations are made, the fixing speed setting (E) is adjusted to optimum level. Since there is no liquid to be evaporated, much lower energy consumption is achieved. Production speed is increased.

Most importantly, even though 160° C. fixing temperature is reached, any rise in temperature that would cause deformation on the surface does not occur (120° C.). Carding and needle methods are the same as before. The nonwoven textile obtained in this mixture is rolled to be carried to other processes.

The operation steps for obtaining the product according to the invention:

A production method which increases the abrasion resistance of nonwoven fabric textiles used in the automotive sector, and it is characterized in that; it comprises the operation steps of:

mixing (A) of two or more fibers that have different melting points, application of opening, carding, and needle operations on said fiber on the nonwoven textile production (B) line, drying in a ram drying oven (C) without the need for using any chemical substance, making nozzle focus adjustment (D) in order to focus at the lowermost surface in the texture section and thus form a heat barrier and a film layer by reaching the highest temperature at that point, making fixing speed adjustment (E) operation at higher values than normal drying speed (+2-3 m/min), mixing PES Bico fiber having a low melting point with PES fiber having a high melting point, at certain ratios, mixing two or more fibers (A) having different melting points, such as 80% PES to 20% Bico, drying in a ram drying oven (C) with a drying air that has 20° C.-30° C. lower temperature.

The invention claimed is:

1. A method for increasing abrasion resistance in a nonwoven textile used in an automotive sector, the method comprising:

mixing at least two fibers in which each of the fibers has a different melting point;

opening, carding and needling the fibers on a nonwoven textile production line;

drying the fibers in a ram drying oven without adding a chemical substance to the fibers;

focusing a nozzle of the ram drying oven at a lowest surface of the fibers so as to increase heat at the lowest surface and to form a heat barrier to obtain a film layer; and adjusting a speed of the nonwoven textile production line.

2. The method of claim 1, the step of mixing comprising:

mixing a polyester fiber and a bicomponent fiber, the bicomponent fiber having a lower melting point than a melting pint of the polyester fiber.

3. The method of claim 2, the polyester fiber being mixed with bicomponent fiber at a weight ratio of 80:20.

* * * * *